United States Patent [19]

Lustenberger

[11] Patent Number: 4,496,393

[45] Date of Patent: Jan. 29, 1985

[54] IMMERSION AND VAPORIZATION CHAMBER

[75] Inventor: Hans Lustenberger, Schaffhausen, Switzerland

[73] Assignee: George Fischer Limited, Schaffhausen, Switzerland

[21] Appl. No.: 459,539

[22] PCT Filed: May 4, 1982

[86] PCT No.: PCT/CH82/00065

§ 371 Date: Jan. 7, 1983

§ 102(e) Date: Jan. 7, 1983

[87] PCT Pub. No.: WO82/03875

PCT Pub. Date: Nov. 11, 1982

[30] Foreign Application Priority Data

May 8, 1981 [CH] Switzerland ..... 2990/81

[51] Int. Cl.[3] ..... C22C 33/10

[52] U.S. Cl. ..... 75/58; 75/130 B; 266/216

[58] Field of Search ..... 266/216; 75/130 B, 130 A, 75/58

[56] References Cited

U.S. PATENT DOCUMENTS 3,788,624 1/1974 Miller ..... 266/216

4,022,444 5/1977 Jackman ..... 266/216

FOREIGN PATENT DOCUMENTS 7900481 7/1979 Intl. Pat. Institute .

*Primary Examiner*—L. Dewayne Rutledge

*Assistant Examiner*—Robert L. McDowell

*Attorney, Agent, or Firm*—Roylance, Abrams, Berdo & Goodman

[57] ABSTRACT

A plunging capsule for introducing a highly volatile, vaporizable additive, such as pure magnesium, into a metal melt in a treatment vessel comprises a wall oriented vertically in an operating position of the capsule. The wall has an upper portion forming two-thirds of the wall and a lower portion forming one-third of the wall, and defines a chamber for the additive. At least one outlet opening is provided in the upper portion. At least one inlet opening is provided in the lower portion. The transverse cross-sectional area of the inlet opening is less than that of the outlet opening.

19 Claims, 1 Drawing Figure

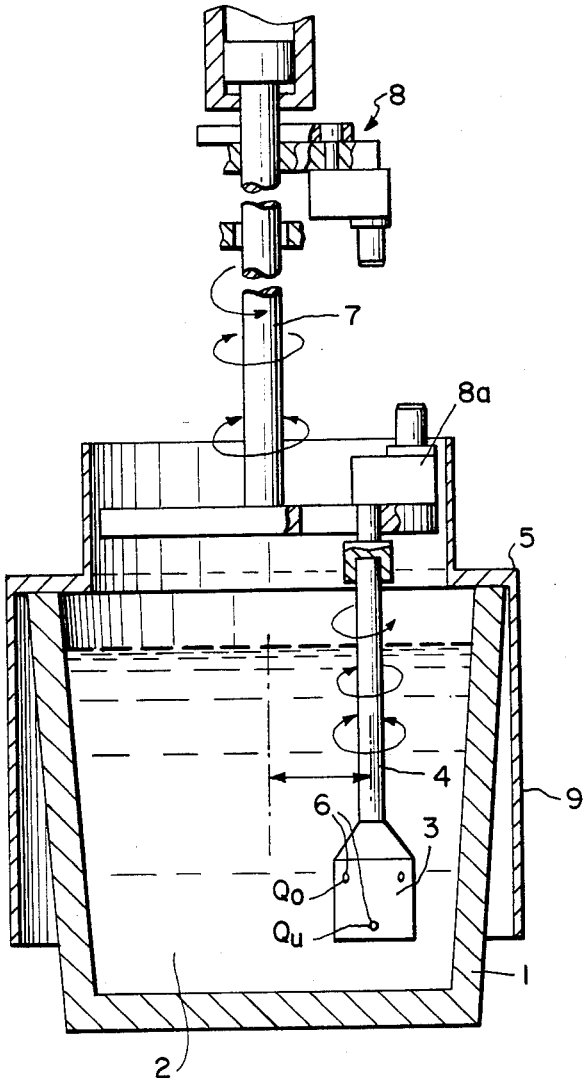
8
7
8a
5
4
9
6
3
$Q_o$
$Q_u$
1
2

IMMERSION AND VAPORIZATION CHAMBER

FIELD OF THE INVENTION

The present invention relates to a plunging vaporization chamber or capsule for introducing highly volatile, vaporizable additives, such as pure magnesium, into a pig iron, cast iron or cast steel melt in a treatment vessel for desulfurization or production of nodular graphite iron, vermicular graphite iron or magnesium treated cast iron.

BACKGROUND OF THE INVENTION

Pure magnesium has been used for desulfurization of pig iron, steel or cast iron, as well as for the production of cast iron with nodular or vermicular graphite or the production of magnesium treated cast iron. Conventionally, the magnesium is introduced by a plunging arrangement made from ceramic working materials, either with or without metal reinforcement.

Most conventional plunging arrangements are disadvantageous in that they are difficult to operate, and are not efficient. Additionally, the results obtained by the conventional arrangements are not sufficiently reproducible.

One conventional plunging capsule is disclosed in German AS No. 2,208,960. This capsule for introducing magnesium into a metal melt has a complicated and expensive construction. Moreover, this conventional arrangement only permits a relatively minor use of the stirring effect produced by the kinetic energy of the emerging vapor from the capsule.

SUMMARY OF THE INVENTION

An object of the present invention is to provide a plunging capsule and process for introducing a highly volatile, vaporizable additive, such as pure magnesium, into a metal melt in which an optimum and thorough mixing of the vapor with the metal melt is achieved in a reproducible manner and to the highest degree possible.

Another object of the present invention is to provide a plunging capsule and process for introducing a highly volatile, and vaporizable additive, such as pure magnesium into a metal melt in which the variations of pressure in the chamber generated by the controlled vaporization of the additive and the pressure variations of the escaping vapor are largely reduced.

A further object of the present invention is to provide a plunging capsule for introducing a highly volatile, vaporizable additive, such as pure magnesium into a metal melt which is simple in construction, is easy to manufacture and operate, and can be employed in a variety of different ways, for example, as a single-use or multi-use chamber.

The foregoing objects are obtained by a plunging capsule for introducing a highly volatile, vaporizable additive, such as pure magnesium into a pin iron, cast iron or cast steel melt in a treatment vessel for desulfurization or production of nodular graphite iron, vermicular graphite iron or magnesium treated cast iron. The capsule comprises a wall oriented vertically in an operating position of the capsule, and has an upper portion forming two-thirds of the wall and a lower portion forming one-third of the wall. The wall defines a chamber for the additive. At least one outlet opening is provided in the upper portion of the wall and has a first transverse cross-sectional area. At least one inlet opening is provided in the lower portion of the wall and has a second transverse cross-sectional area which is less than the first transverse cross-sectional area.

The foregoing objects are also obtained by a process for introducing magnesium into pig iron, cast iron or cast steel melt in a treatment vessel for desulfurization or production of nodular graphite iron, vermicular graphite iron or magnesium treated cast iron, comprising filling a chamber of a capsule with liquid magnesium. The capsule has a vertical wall with an upper portion forming two-thirds of the wall and a lower portion forming one-third of the wall. An outlet opening is provided in the upper portion with a first transverse cross-sectional area. An inlet opening is provided in the lower portion with a second transverse cross-sectional area less than the first cross-sectional area. The magnesium is solidified and the capsule filled with solidified magnesium is submerged into the melt in the treatment vessel.

Optimally, the ratio of cross-sectional areas of the openings should satisfy the relationship $$(Q_o/Q_u) \geqq 2$$

where $Q_o$ = the cross-sectional area of the upper openings and $Q_u$ = the cross-sectional area of the lower opening or openings.

It is particularly advantageous, when the capsule is connected to a holding and filler pipe which projects upwardly from the capsule wall out of the melt. The pipe can form a pressure type chamber with the wall with an insertable sealing body.

The sealing body can be advantageously spaced from the chamber entrance upwardly in the direction of the end of the holding and filling pipe projecting upwardly from the melt to enlarge the evaporation chamber volume.

Other objects, advantages and salient features of the present invention will become apparent from the following detailed description, which, taken in conjunction with the annexed drawing, discloses preferred embodiments of the present invention.

BRIEF DESCRIPTION OF THE DRAWINGS

The sole drawing FIGURE, which forms a part of this disclosure, is a side elevational view in section illustrating a system for introducing a highly volatile, vaporizable additive into a metal melt according to the present invention.

DETAILED DESCRIPTION OF PREFERRED EMBODIMENTS OF THE INVENTION

Referring to the drawing FIGURE, a treatment vessel 1, in the form of a transfer ladle, for the melt 2 is coated with a fire-proof or ceramic material. The metal melt 2 in transfer ladle 1 can be cast iron, pig iron or steel melt. A plunging capsule 3, according to the present invention, is submerged within melt 2 at a predetermined speed. The capsule is coupled to a filling and holding pipe 4, and is submerged into the melt through an opening in an easily removable lid or cover 5 on the treatment vessel. The filling and holding pipe may have a limit when the cover is not fixed on pipe 4, or the cover can be fixed on the pipe and easily removable with it.

The buoyancy, vaporization and reaction forces on the capsule can be transmitted through the plunging arrangement and the cover of the treatment vessel, by the plunging arrangement alone, or by the cover alone. The interior or cavity of capsule 3 is filled with pure magnesium in lumps or in liquid form.

The interior and exterior configuration of the capsule is selected and dimensioned in accordance with the flow characteristics of the vapor and of the bath. The capsule can have a chamber which is elliptical in horizontal and/or vertical section.

As a result of the flow criteria, and to optimize utilization of the stirring effect developed during the mixing of the magnesium vapor with the melt, the capsule is preferably submerged in an eccentric position with regard to a vertical central axis of the treatment vessel. The eccentric position of the capsule in the treatment vessel and/or the openings disposed eccentrically in the capsule enhance, by suitable geometry, the bath rotation, the stirring effect, and the separation of the reaction products, such as slag.

The openings 6 provided in the capsule wall are disposed on at least two planes or levels relative to the direction of insertion of the capsule into the melt. The openings can differ in number, size and arrangement in the capsule wall. The number, size and arrangement of the openings are selective to optimize vaporization of the pure magnesium in the chamber and the reaction of the vapor with the melt. In this manner, a regulated, dosed vaporization of the pure magnesium and the ensuing reaction with the melt can be controlled within narrow limits. The openings in the lower third of the capsule wall have a total transverse cross-sectional area $Q_u$ which is smaller than the total transverse cross-sectional area $Q_o$ of the openings in the upper two-thirds of the chamber wall. The number and size of these openings, and the distance between the openings, depend on various factors, such as chamber volume, sulfur content and treatment temperature of the melt being treated. The openings can be arranged in a symmetrical or an irregular manner. The sum, $(Q_o+Q_u)$ is preferably in the range between 2 $cm^2$ and 300 $cm^2$, while the transverse cross-sectional area of each opening is preferably between 1 $cm^2$ and 100 $cm^2$.

The capsule is connected with filler and holding pipe 4 which projects upwardly through protective cover 5 of treatment vessel 1. This pipe can be coated partially or completely along its length projecting from the capsule. The coating can be a fire-proof layer, preferably made of ceramic material. Additionally, the coating can be provided interiorly, exteriorly or on both the interior and exterior surfaces of the pipe.

The vertical axis of holding and filling pipe 4 can conicide or be laterally displaced relative to the vertical central axis 7 of treatment vessel 1. A suitable arrangement of drive mechanisms 8 and 8*a* can be provided for rotating pipe 4 and/or pulsating pipe 4 such that three rotational movements and/or a vertical pulsating movement can be combined.

Protective cover 5 has a depending, collar-shaped jacket 9 extending outwardly along the outer wall of treatment vessel 1, serving as a splash guard. The protective cover has one or more exit openings for the vapor which is not absorbed by the melt or which is discharged by the melt. For optimum safety of operating personnel, the length of the jacket must be selected such that the lower edge of the jacket overlaps the upper edge of the treatment vessel before the capsule is submerged into the melt. The hood-shaped cover may also be used for suctioning the vapors and reaction products in the air (e.g., MgO) by connecting the cover exit openings directly with one or a plurality of evacuation lines, for example, by employing one or several flexible metal tubes.

The filler pipe 4 can be closed directly at the chamber wall in a pressure-type manner by a sealing body. Alternatively, to enlarge the inside space or volume of the chamber, the sealing body can be attached at a location spaced from the chamber entrance upwardly in the direction of the end of the pipe projecting from the treatment vessel. This permits significant reduction of pressure variations which can be generated in the capsule by the controlled vaporization of the magnesium, thereby reducing the forces acting in and at the reaction chamber.

The capsule may be formed as a one-way or single-use device. In this manner, after complete vaporization of the contents, the capsule detaches itself from its support partially or completely, and precipitates into the melt. Alternatively, the capsule can completely disintegrate within the melt.

The capsule can also be formed in two or more parts. With two parts, the lower portion can form a container receiving the magnesium, which container is closed by the second, cover part. The cover part is connected with a handle by a suitable screw closure. In this embodiment, the filling pipe is not required since it is replaced by the handle.

The capsule can also be anchored at the bottom of the treatment vessel, for example, by bolts extending through the bottom of the treatment vessel. The capsule, with the filling and holding pipe or with the holding handles, is then covered with the melt. Preferably, the capsule is located in an eccentrically submerged position. The stirring effect, produced by the capsule by the kinetic energy of the emitted vapor, is increased during covering of the capsule by the pouring in of the metal melt, without the rotational and pulsating movements of the capsule. The pouring in of the melt will maximize and permit reproducible effectiveness of the melt treatment.

When the capsule is filled with liquid magnesium, for example, through one of the openings in the capsule wall, the magnesium is submerged into the melt after solidification of the magnesium. After solidification of the magnesium, a more quiet course of reaction will occur due to the more favorable ratio between volume and surface area of solidified magnesium in the capsule chamber, as compared to lumps of magnesium in the capsule chamber. Additionally, a more accurate dosing of the magnesium weight in the capsule chamber can be achieved and the filler pipe in the holding handle of the capsule is no longer required.

The walls of capsule 3 can be formed of conventional high-strength, heat-resistant or fire-resistant materials or combinations of materials. Additionally, the capsule can be provided with or without metal armoring or other materials or combination of materials formed as a supporting skeleton. Such armoring or reinforcement can be combined with the filler and holding pipe or holding handle.

The capsule of the present invention will permit a reproducible desulfurization and adjustment of the residual magnesium content, as well as a high and reproducible magnesium recovery. The treatment sequence may be increased significantly since the capsule of the present invention, relative to known capsules, is better adapted to operational conditions and involves simpler handling.

While various embodiments have been chosen to illustrate the invention, it will be understood by those skilled in the art that various changes and modifications can be made therein without departing from the scope of the invention as defined in the appended claims.

I claim:

1. A plunging capsule for introducing a highly volatile, vaporizable additive, such as pure magnesium, into a pig iron, cast iron or cast steel melt in a treatment vessel for desulfurization or production of nodular graphite iron, vermicular graphite iron or magnesium treated cast iron, the capsule comprising:

a wall oriented vertically in an operating position of the capsule, and having an upper portion forming two-thirds of said wall and a lower portion forming one-third of said wall, said wall defining a chamber for the additive;

at least one outlet opening in said upper portion having a first transverse cross-sectional area; and at least one inlet opening in said lower portion having a second transverse cross-sectional area, said second transverse cross-sectional area being less than said first cross-sectional area.

2. A plunging capsule according to claim 1 wherein $$(Q_o/Q_u) \geqq 2$$

where $Q_o$=said first transverse cross-sectional area, and $Q_u$=said second transverse cross-sectional area.

3. A plunging capsule according to claim 1 wherein a holding and filling pipe is coupled to and projects upwardly from said wall, said pipe being sealed to said wall and forming a pressure tight closure for said chamber.

4. A plunging capsule according to claim 3 wherein said pipe is coated interiorly and exteriorly with ceramic material.

5. A plunging capsule according to claim 3 wherein said pipe comprises ceramic material.

6. A plunging capsule according to claim 1 wherein the capsule comprises first and second parts and means for coupling said parts after one of said parts has been filled with the additive.

7. A plunging capsule according to claim 1 wherein holding means is attached to said wall by coupling means for supporting said wall in the treatment vessel, said coupling means releasing said wall from said holding means upon complete vaporization of the additive.

8. A plunging capsule according to claim 1 wherein said wall reacts with the melt to disintegrate upon complete vaporization of the additive.

9. A plunging capsule according to claim 1 wherein said chamber is elliptical in horizontal section.

10. A plunging capsule according to claim 9 wherein said chamber is elliptical in vertical section.

11. A plunging capsule according to claim 1 wherein said chamber is elliptical in vertical section.

12. A plunging capsule according to claim 1 wherein said openings are arranged in an irregular manner in said wall.

13. A plunging capsule according to claim 1 wherein said openings are symmetrically arranged in said wall.

14. A plunging capsule according to claim 1 wherein said transverse cross-sectional area of each of said openings is between 1 $cm^2$ and 100 $cm^2$.

15. A plunging capsule according to claim 1 wherein $$2\ cm^2 < Q_o + Q_u < 300\ cm^2$$

where $Q_o$=said first transverse cross-sectional area, and $Q_u$=said second transverse cross-sectional area.

16. A plunging capsule according to claim 1 wherein support means are coupled to said wall for rotating said wall about a vertical axis in the treatment vessel.

17. A plunging capsule according to claim 16 wherein said support means includes means for moving said wall in a pulsating manner.

18. A plunging capsule according to claim 1 wherein support means are coupled to said wall for moving said wall in a pulsating manner.

19. A process for introducing magnesium into pig iron, cast iron or cast steel melt in a treatment vessel for desulfurization or production of nodular graphite iron, vermicular graphite iron or magnesium treated cast iron, comprising the steps of:

filling a chamber of a capsule with liquid magnesium, the capsule having a vertical wall with an upper portion forming two-thirds of the wall and a lower portion forming one-third of the wall, an outlet opening in the upper portion with a first transverse cross-sectional area and a inlet opening in the lower portion with a second transverse cross-sectional area less than the first transverse cross-sectional area;

solidifying the magnesium; and submerging the capsule filled with solidified magnesium into the melt in the treatment vessel.

* * * * *